US011175070B2

(12) United States Patent
Jacques et al.

(10) Patent No.: US 11,175,070 B2
(45) Date of Patent: Nov. 16, 2021

(54) HEAT EXCHANGER FOR HEATING WATER

(71) Applicant: Laars Heating Systems Company, Rochester, NH (US)

(72) Inventors: Christopher J. Jacques, West Newbury, MA (US); Andrew Hodsdon, Berwick, ME (US)

(73) Assignee: LAARS HEATING SYSTEMS COMPANY, Rochester, NH (US)

( * ) Notice: Subject to any disclaimer, the term of this patent is extended or adjusted under 35 U.S.C. 154(b) by 35 days.

(21) Appl. No.: 16/474,833

(22) PCT Filed: Dec. 28, 2017

(86) PCT No.: PCT/US2017/068684
§ 371 (c)(1),
(2) Date: Jun. 28, 2019

(87) PCT Pub. No.: WO2018/125990
PCT Pub. Date: Jul. 5, 2018

(65) Prior Publication Data

US 2019/0323729 A1 Oct. 24, 2019

Related U.S. Application Data

(60) Provisional application No. 62/440,580, filed on Dec. 30, 2016.

(51) Int. Cl.
*F24H 1/40* (2006.01)
*F24H 9/00* (2006.01)
(Continued)

(52) U.S. Cl.
CPC ..... *F24H 1/40* (2013.01); *F24H 9/0026* (2013.01); *F28D 7/1669* (2013.01); *F28D 2021/0024* (2013.01)

(58) Field of Classification Search
CPC .. F24H 1/40; F24H 9/0026; F28D 2021/0024; F28F 17/005
(Continued)

(56) References Cited

U.S. PATENT DOCUMENTS 2,493,969 A 1/1950 James
3,734,065 A 5/1973 Reid et al.
(Continued)

FOREIGN PATENT DOCUMENTS

EP 2072938 A2 6/2009

OTHER PUBLICATIONS

International Preliminary Report on Patentability for International Application No. PCT/US2017/068684, dated Jul. 2, 2019, 7 pages.
(Continued)

*Primary Examiner* — Steven B Mcallister
*Assistant Examiner* — Benjamin W Johnson
(74) *Attorney, Agent, or Firm* — RatnerPrestia

(57) ABSTRACT

Aspects of the invention provide a heat exchanger that includes a shell coupled to a top tube sheet and a bottom tube sheet. The shell at least partially defines an interior region. The heat exchanger also includes a burner positioned to deliver combustion gases into the interior region. A plurality of tubes, configured to circulate a fluid therein, extend through the interior region around the burner. The heat exchanger further includes a divider that extends within the interior region from the top tube sheet to the bottom tube sheet and between one of the plurality of tubes and another non-adjacent tube of the plurality of tubes. The divider and the plurality of tubes define a receiving section of the interior region for receiving combustion gases from the burner and an exhaust section of the interior region in fluid communication with a combustion gas vent.

17 Claims, 8 Drawing Sheets

(51) Int. Cl.
*F28D 7/16* (2006.01)
*F28D 21/00* (2006.01)

(58) Field of Classification Search
USPC ..... 122/18.3
See application file for complete search history.

(56) References Cited

U.S. PATENT DOCUMENTS

| | | | | |
|---|---|---|---|---|
| 4,401,058 | A * | 8/1983 | Charrier | F24H 1/403 122/18.4 |
| 7,281,497 | B2 * | 10/2007 | Le Mer | F24H 1/43 122/18.1 |
| 7,290,503 | B2 | 11/2007 | Missoum et al. | |
| 2007/0209606 | A1 * | 9/2007 | Hamada | F28F 9/0246 122/18.1 |
| 2010/0326373 | A1 | 12/2010 | Lapierre | |
| 2011/0041781 | A1 * | 2/2011 | Deivasigamani | F28D 1/0472 122/18.1 |
| 2016/0282011 | A1 | 9/2016 | Umakoshi | |

OTHER PUBLICATIONS

International Search Report and Written Opinion for International Application No. PCT/US2017/068684, dated Mar. 13, 2018, 7 pages.

* cited by examiner

HEAT EXCHANGER FOR HEATING WATER

CROSS REFERENCE TO RELATED APPLICATION

This application is a U.S. National Phase Patent Application of PCT Patent Application No. PCT/US2017/068684, filed Dec. 28, 2017, which is related to and claims the benefit of U.S. Provisional Application No. 62/440,580, entitled HEAT EXCHANGER FOR HEATING WATER, filed on Dec. 30, 2016, the contents of each of these applications being incorporated herein by reference for all purposes.

FIELD OF THE INVENTION

This disclosure relates to heat exchangers, and more particularly, to heat exchangers having a divider as well as methods and systems for using the same.

BACKGROUND OF THE INVENTION

Commercial and residential heat exchangers, e.g., water heaters, typically heat water by generating tens of thousands, and even hundreds of thousands, of BTUs. As fuel costs have risen and environmental concerns, become more prominent, manufacturers of water heaters have attempted to increase the efficiency of their products. Accordingly, maximal heat exchange efficiency has long been an object of commercial and residential water heater manufacturers.

It would, thus, be desirable to provide a heat exchanger that satisfies the needs of purchasers for improved heat exchange efficiency.

SUMMARY OF THE INVENTION

Aspects of the invention relate to heat exchangers and parts thereof, as well as methods of manufacturing and using such heat exchangers.

In accordance with one aspect, the invention provides a heat exchanger that includes a shell coupled to a top tube sheet and a bottom tube sheet. The shell at least partially defines an interior region. The heat exchanger also includes a burner positioned to deliver combustion gases into the interior region. A plurality of tubes, configured to circulate a fluid therein, extend through the interior region around the burner. The heat exchanger further includes a divider that extends within the interior region from the top tube sheet to the bottom tube sheet and between one of the plurality of tubes and another non-adjacent tube of the plurality of tubes. The divider and the plurality of tubes define a receiving section of the interior region for receiving combustion gases from the burner and an exhaust section of the interior region in fluid communication with a combustion gas vent.

According to another aspect, the invention includes a heat exchanger having a shroud at least partially defining an interior region and a plurality of tubes annularly arranged in the interior region and spaced from the shroud. The plurality of tubes define a center region that extends inward from the plurality of tubes and a skirt region that is interposed between the plurality of tubes and the shroud. The heat exchanger also includes a burner configured to deliver combustion gases to the center region and a combustion gas vent that is coupled to the center region for exhausting combustion gases. Additionally, the heat exchanger includes a divider positioned to separate the center region by extending between two of the plurality of tubes. The divider is positioned such that the combustion gas vent receives combustion gases that flow through the skirt region.

In accordance with another aspect, the invention provides a heat exchanger including a shell at least partially defining an interior region, a burner configured to deliver combustion gases into the interior region, and a plurality of tubes configured to circulate a fluid therein. The plurality of tubes extends through the interior region and is interposed between the burner and the shell. The plurality of tubes further defines a center region extending inwardly from the plurality of tubes. A combustion gas vent is coupled to the center region for exhausting combustion gases from the center region. The heat exchanger also includes a divider interposed between at least two of the plurality of tubes and positioned to separate the interior region into an upstream side adjacent a first side of the divider and a downstream side adjacent an opposed second side of the divider. The combustion gases from the burner are received by the upstream side, and the combustion gases are exhausted from the downstream side by the combustion gas vent.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. It is emphasized that according to common practice, the various features of the drawings are not drawn to scale unless otherwise indicated. On the contrary, the dimensions of the various features may be expanded or reduced for clarity. Included in the drawings are the following figures.

DETAILED DESCRIPTION OF THE INVENTION

Figure 1:
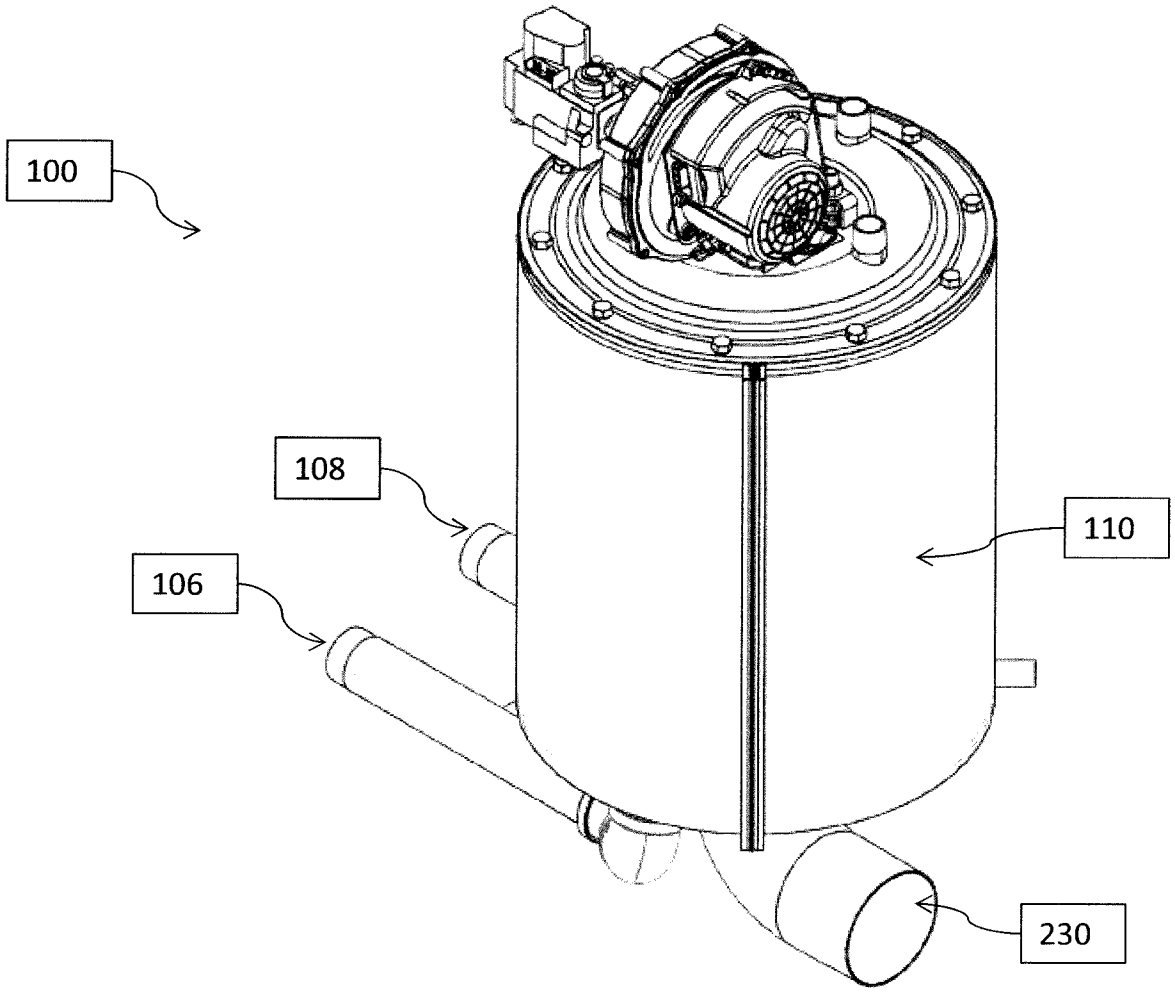
FIG. 1 is a perspective view of an embodiment of a heat exchanger in accordance with aspects of the present invention.

A detailed description of various, non-limiting embodiments of the invention follows. Although the invention is illustrated and described herein with reference to specific embodiments, the invention is not intended to be limited to the details shown. Rather, various modifications may be made in the details within the scope and range of equivalents of the claims and without departing from the invention.

Referring to the figures generally, provided is a non-limiting exemplary embodiment of a heat exchanger 100 having a shell 110 coupled to a first tube sheet 180*a* and a second tube sheet 180*b*. The shell 110 at least partially defines an interior region 111. The heat exchanger 100 has a burner 120 positioned to deliver combustion gases into the interior region 111 and a plurality of tubes 150 configured to circulate a fluid therein. The plurality of tubes 150 extend through the interior region 111 around the burner 120. A divider 210 extends within the interior region 111 from the first tube sheet 180*a* to the second tube sheet 180*b* and between one of the plurality of tubes 150 and another non-adjacent tube of the plurality of tubes 150. The divider 210 and the plurality of tubes 150 define a receiving section 222 of the interior region 111 for receiving combustion gases from the burner 120 and an exhaust section 224 of the interior region 111 in fluid communication with a combustion gas vent 230.

In one aspect of the invention, high efficiency heat exchangers that produce condensate as a result of efficient heat transfer between the combustion gases and the fluid to be heated are provided. In another aspect of the invention, provided are heat exchangers having a reduced size (e.g., a smaller "footprint"), while maintaining high rates of heat loading (e.g., heat exchange).

Figure 2:
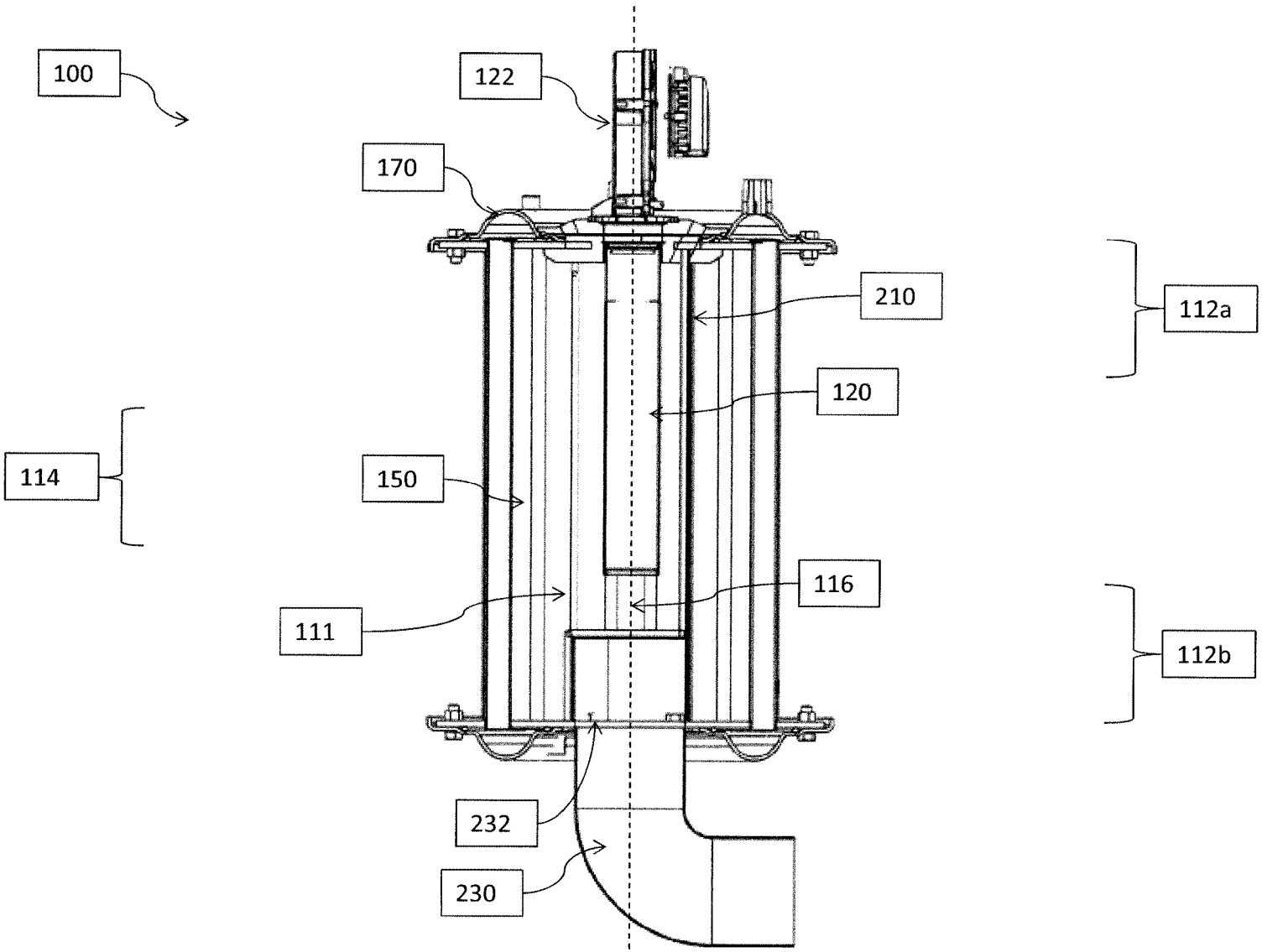
FIG. 2 is a cross-sectional view of the heat exchanger of FIG. 1.

Referring specifically to FIGS. 1 and 2, illustrated is a non-limiting embodiment of a heat exchanger 100 having a divider 130 disposed between a plurality of tubes 150. As a general overview, heat exchanger 100 includes a shell 110, a burner 120, a plurality of tubes 150, one or more headers 170, and a divider 210.

Shell 110 is configured to at least partially define an interior region 111. Shell 110 is coupled to a first tube sheet 180*a* (e.g., a top tube sheet) and a second tube sheet 180*b* (e.g., a bottom tube sheet) and may extend from a first end region 112*a* to a second end region 112*b* of heat exchanger 100. In one embodiment, shell 110 includes a shroud that at least partially defines an interior region. The shroud may be configured to optimize heat transfer of heat exchanger 100. Shell 110 is not limited to any particular geometrical shape, and thus, may be configured to form any shape that defines an interior region 111 that is suitable for positioning the features of heat exchanger 100 therein. For example, shell 110 may form a cylinder, an oval cylinder, a cube, a rectangular cube, a pyramid, etc.

Burner 120 is positioned to deliver combustion gases into interior region 111 defined by shell 110. In one embodiment, burner 120 delivers combustion gases to center region 220, which is further described below, of interior region 111. Although burner 120 is positioned along a longitudinal axis 116 of interior region 111 in FIG. 1, burner 120 may be disposed in interior region 111 in a position that is offset from longitudinal axis 116 of interior region 111. For example, burner 120 may be positioned in interior region 111 closer to one side of shell 110. In one embodiment, burner 120 is positioned equidistant from the closest portion of the divider 210 and the closest tube of the plurality of tubes 150. Preferably, burner 120 is positioned within interior region 111. In one embodiment, burner 120 extends from an end region 112*a* or 112*b* to a center portion 114 of interior region 111. In another embodiment, however, burner 120 is positioned outside interior region 111, but in combustion gas flow communication with interior region 111 such that combustion gases produced by burner 120 may flow into interior region 111. Burner 120 is not particularly limited to any source of combustion material and, thus, may be configured to burn gas fuel, oil, coal, etc.

A fuel mixture apparatus 122 is coupled (e.g., directly or indirectly by way of a duct) to be in fluid communication with burner 120. Fuel mixture apparatus 122 provides a fuel mixture of fuel and air/oxygen to burner 120. Fuel mixture apparatus 122 may be a fan, blower, or the like. Preferably, fuel mixture apparatus 122 provides a ratio of air to fuel that enables efficient combustion of the fuel mixture.

The fuel mixture apparatus 122 may be coupled to a controller configured to regulate fuel mixture apparatus 122 and/or enable a user to manually adjust the amount of fuel mixture provided by fuel mixture apparatus 122. The controller may be configured to regulate and/or adjust fuel mixture apparatus 122 using a single stage process, a modulating process, and/or a multi-stage (step-modulation) process.

The heat exchanger 100 also includes a combustion gas vent 230 for venting combustion gas. Combustion gas vent 230 is in fluid communication with interior region 111, e.g., by way of coupling to aperture 232. In one embodiment, combustion gas vent 230 is coupled to center region 220 of interior region 111, which is further disclosed below. Combustion gas vent 230 may be coupled to and/or configured to be a condensation trap.

Referring to FIGS. 2-5, heat exchanger 100 also includes a plurality of tubes 150 configured to circulate a fluid therein. The plurality of tubes 150 extends through interior region 111, e.g., from a first end region 112*a* of interior region 111 to a second end region 112*b* of interior region 111, which may be opposed the first end region 112*a*. The plurality of tubes 150 may be positioned annularly around burner 120 to form, e.g., one or more annular rows of tubes. In one embodiment, the plurality of tubes 150 forms a single annular row of tubes. In another embodiment, the plurality of tubes 150 forms two annular rows of tubes. The plurality of tubes 150 may be annularly arranged to form a non-circular arrangement, such as an elliptical arrangement. Alternatively, the plurality of tubes 150 may be annularly arranged to form a circular arrangement, whereby the plurality of tubes 150 are radially spaced from burner 120. The plurality of tubes 150 delineates a center region 220 extending inward from the plurality of tubes 150 and a skirt region 226 interposed between the plurality of tubes 150 and shell 110 and/or the shroud. The plurality of tubes 150 may include fins, baffles, and/or other features that promote heat transfer and/or modify the flow of fluid circulating within the plurality of tubes 150 or the flow of combustion gasses circulating around/near the plurality of tubes 150.

The plurality of tubes 150 includes an inner set of tubes 152 and an outer set of tubes 154. Inner set of tubes 152 is closer to burner 120 than outer set of tubes 154. Inner set of tubes 152 and outer set of tubes 154 may be positioned adjacent to one another such that, e.g., an outer surface 156 of inner set of tubes 152 is adjacent to an outer surface 158 of outer set of tubes 154. For example, outer surface 156 of inner set of tubes 152 may buttress (e.g., may contact at various points along the tubes) outer surface 158 of outer set of tubes 154. In one embodiment, the clearance between outer surface 156 of inner set of tubes 152 and outer surface 158 of outer set of tubes 154 is less than 0.05 inches. By reducing the space between the plurality of tubes 150, the efficiency of heat exchanger 100 may be increased as the residence time of the combustion gas within heat exchanger 100 is increased.

Outer set of tubes 154 is staggered from inner set of tubes 152. By staggering outer set of tubes 154 from inner set of tubes 152, more heat transfer can be achieved while limiting the distance between the plurality of tubes 150 and burner 120, thereby minimizing the size and/or "foot print" of heat exchanger 100 and optimizing heat transfer. The staggered configuration may form an angle ϕ between two outer tubes 154 and one inner tube 152 and/or between two inner tubes 152 and an outer tube 154. The staggered configuration may form an angle ϕ that is between 180° and 15°.

Baffle segments 160 are annularly positioned in interior region 111 adjacent the plurality of tubes 150. Baffle segments 160 may be adjacent to one or more tubes of the plurality of tubes 150, e.g., one or more tubes of outer set of tubes 154 and/or one or more tubes of inner set of tubes 152. In one embodiment, baffle segments 160 extend from a position adjacent to a first tube of outer set of tubes 154 to a position adjacent to a second tube of outer set of tubes 154.

Adjacent baffle segments 160 define gaps 161 for the flow of combustion gases. Gaps 161 may be configured to hinder and/or reduce the amount of combustion gases flowing therethrough. The size of gaps 161 may be adjusted during manufacturing, during installment, or after use but before subsequent use. For example, the size of gaps 161 may be determined by selecting adjacent baffle segments 160 of a specific size. The plurality of tubes 150 are coupled to one or more tube sheets 180 and headers 170.

Referring to FIGS. 2-6, first tube sheet 180*a* is positioned at an end region 112*a* or 112*b* of shell 110 and coupled to the plurality of tubes 150. Second tube sheet 180*b* is positioned at the other end region 112*a* or 112*b* opposed first tube sheet 180*a* and is also coupled to the plurality of tubes 150. As illustrated in FIG. 2, heat exchanger 100 may be employed as a vertically oriented heat exchanger having a top first tube sheet 180*a* and a bottom second tube sheet 180*b*. Tube sheets 180 define a set of apertures 181 and/or 183 in water flow communication with the plurality of tubes 150. For example, tube sheets 180 may define an inner set of apertures 181 in water flow communication with inner set of tubes 152 and an outer set of apertures 183 in water flow communication with outer set of tubes 154.

Header 170 may be formed as a single unitary item configured to form a cavity upon coupling with tube sheet 180. Header 170 may also contain one or more O-rings to facilitate a seal between header 170 and tube sheet 180. Header 170, tube sheet 180, and/or shell 110 may be coupled to each other directly or indirectly by mechanical means, such as welding, threading, riveting, bolting, etc., and/or non-mechanical means, such as adhesives, etc.

Referring to FIGS. 2-7D, heat exchanger 100 includes a divider 210 extending within interior region 111 of heat exchanger 100. Divider 210 may be configured to extend from first tube sheet 180*a* to second tube sheet 180*b* and between one of the plurality of tubes 150 and another non-adjacent tube of the plurality of tubes 150. Preferably, divider 210 forms a first seal extending from first tube sheet 180*a* to second tube sheet 180*b* with one of the plurality of tubes 150 and forms a second seal extending from first tube sheet 180*a* to second tube sheet 180*b* with another, non-adjacent one of the plurality of tubes 150. For example, in one embodiment, divider 210 is coupled to a first outer tube 154 and a second, non-adjacent outer tube 154 to form a seal extending from first tube sheet 180*a* to second tube sheet 180*b* along the first and second outer tubes 154. Preferably, divider 210 also forms a seal with first tube sheet 180*a* and second tube sheet 180*b*.

Divider 210 may be configured to have a main body portion 212 and a shoulder portion 216. Main body portion 212 has an edge section 214 that may be adapted for coupling to one or more of the plurality of tubes 150. For example, edge section 214 may be formed to receive one or more of the plurality of tubes 150 and, preferably, produce an airtight seal with such tube 150. Additionally or alternatively, edge section 214 may be configured as a flange adapted for welding to one or more of the plurality of tubes 150, such as one or more of the outer set of tubes 154.

Figure 3B:
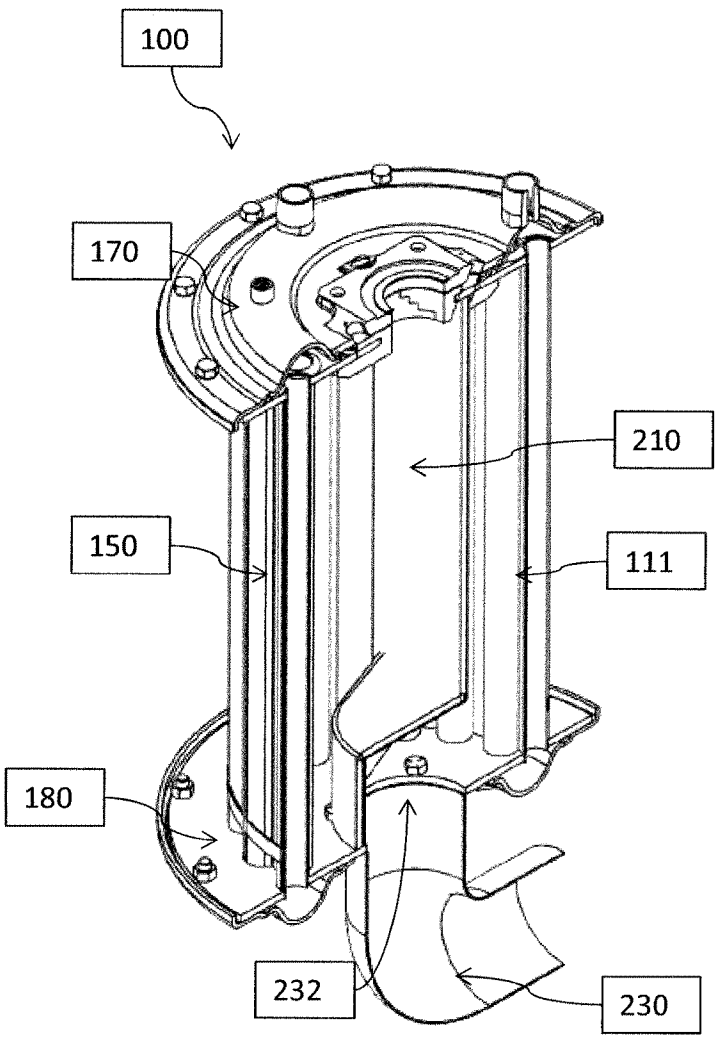
FIG. 3B is the perspective cross-sectional view of FIG. 3A without the burner.
Figure 3A:
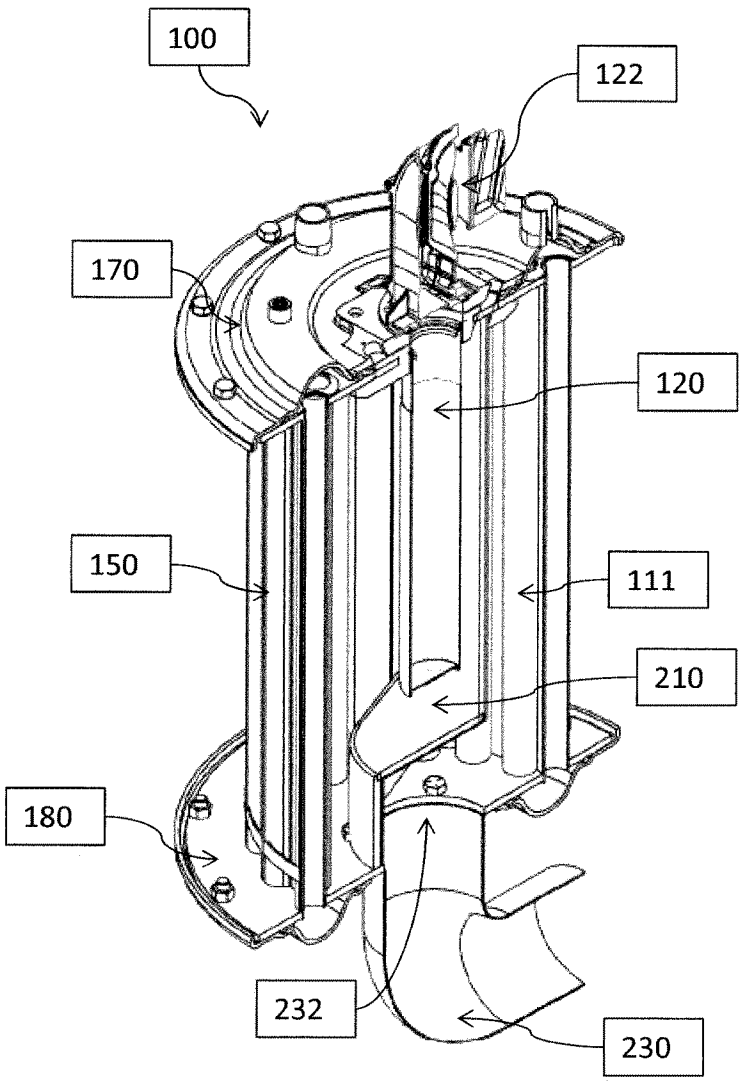
FIG. 3A is a perspective cross-sectional view of the heat exchanger of FIG. 1 without the shell.
Figure 4:
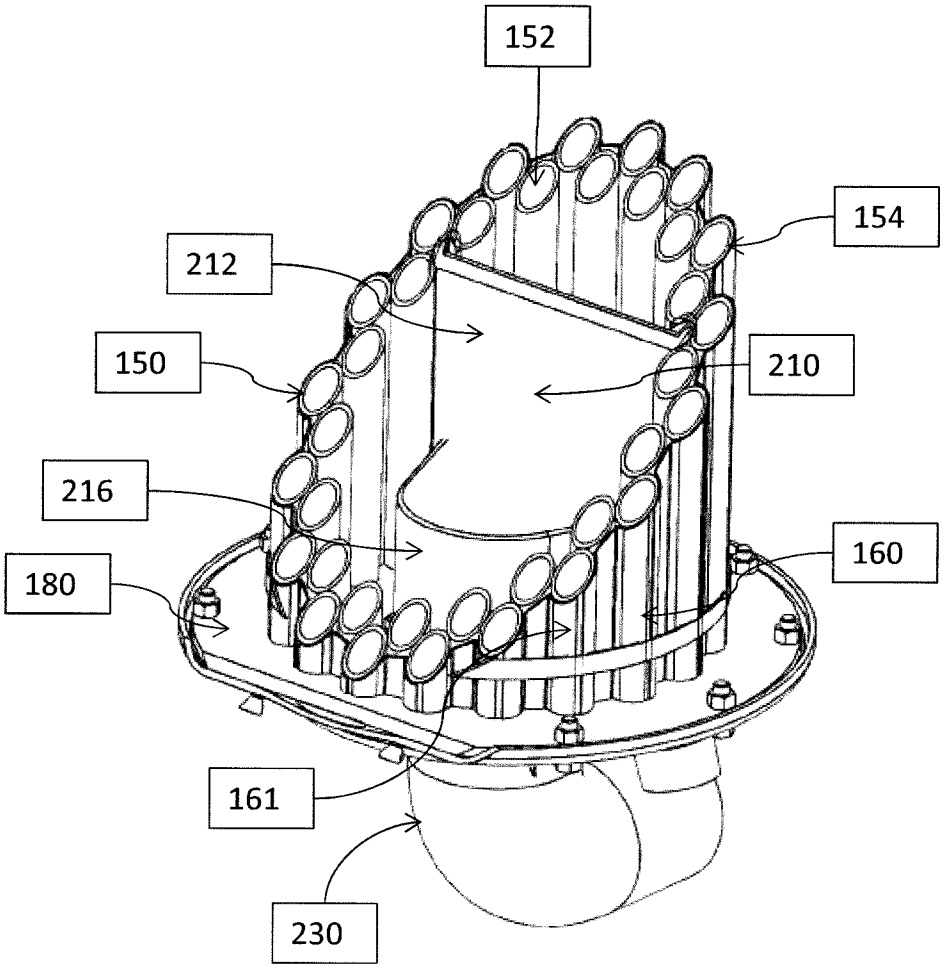
FIG. 4 is another perspective cross-sectional view of the heat exchanger of FIG. 1 without the shell.

Shoulder portion 216 extends from main body portion 212 to envelop aperture 232 of combustion gas vent 230. As illustrated in FIGS. 2 and 3A, divider 210 may be positioned in heat exchanger 100 such that shoulder portion 216 envelops aperture 232 of combustion gas vent 230 and separates burner 120 and aperture 232 of combustion gas vent 230, thereby placing burner 120 in direct combustion gas communication with a first side 218*a* of divider 210 and placing aperture 232 of combustion gas vent 230 in direct gas communication with a second opposed side 218*b* of divider 210. Divider 210 may be positioned such that combustion gas vent 230 receives combustion gases that flow through the skirt region 226. In one embodiment, divider 210 does not extend into skirt region 226, such that combustion gases flow from burner 120 through skirt region 226 to reach combustion gas vent 230.

Divider 210 advantageously increases the heat transfer of heat exchanger 100 by modifying the flow of combustion gas through heat exchanger 100. Divider 210 may delineate at least two sections of the interior region 111 that facilitate desired flow of the combustion gases. For example, divider 210 may define a receiving section 222 of interior region 111 for receiving combustion gases from burner 120 and exhaust section 224 of interior region 111 in fluid communication with combustion gas vent 230. In one embodiment, receiving section 222 and exhaust section 224 of interior region 111 are within center region 220 defined by the annular arrangement of the plurality of tubes 150.

By positioning divider 210 in center region 220 to define receiving section 222 and exhaust section 224, combustion gases may be forced to flow through gaps 161. In one embodiment, the combustion gases flow through gaps 161 defined by adjacent baffle segments 160 at least twice prior to flowing into combustion gas vent 230. For example, the combustion gases may through gaps 161 in upstream side 228 and may flow through gaps 161 in downstream side 229. In one embodiment, the combustion gases flow from receiving section 222 through gaps 161 into skirt section 226 and, subsequently, through gaps 161 into exhaust section 224.

Figure 5:
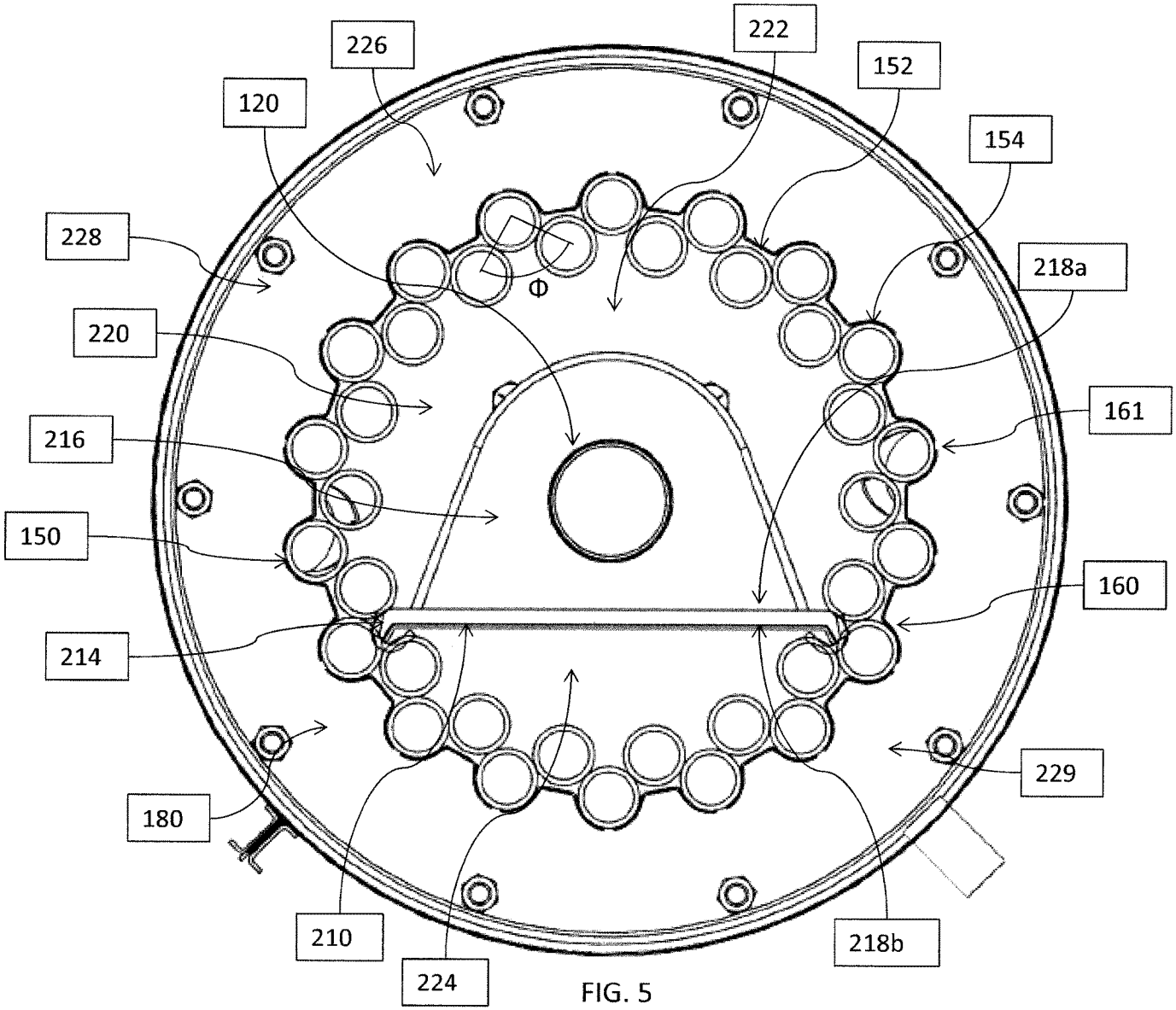
FIG. 5 is a cross-sectional top view of the heat exchanger of FIG. 1.
Figure 6:
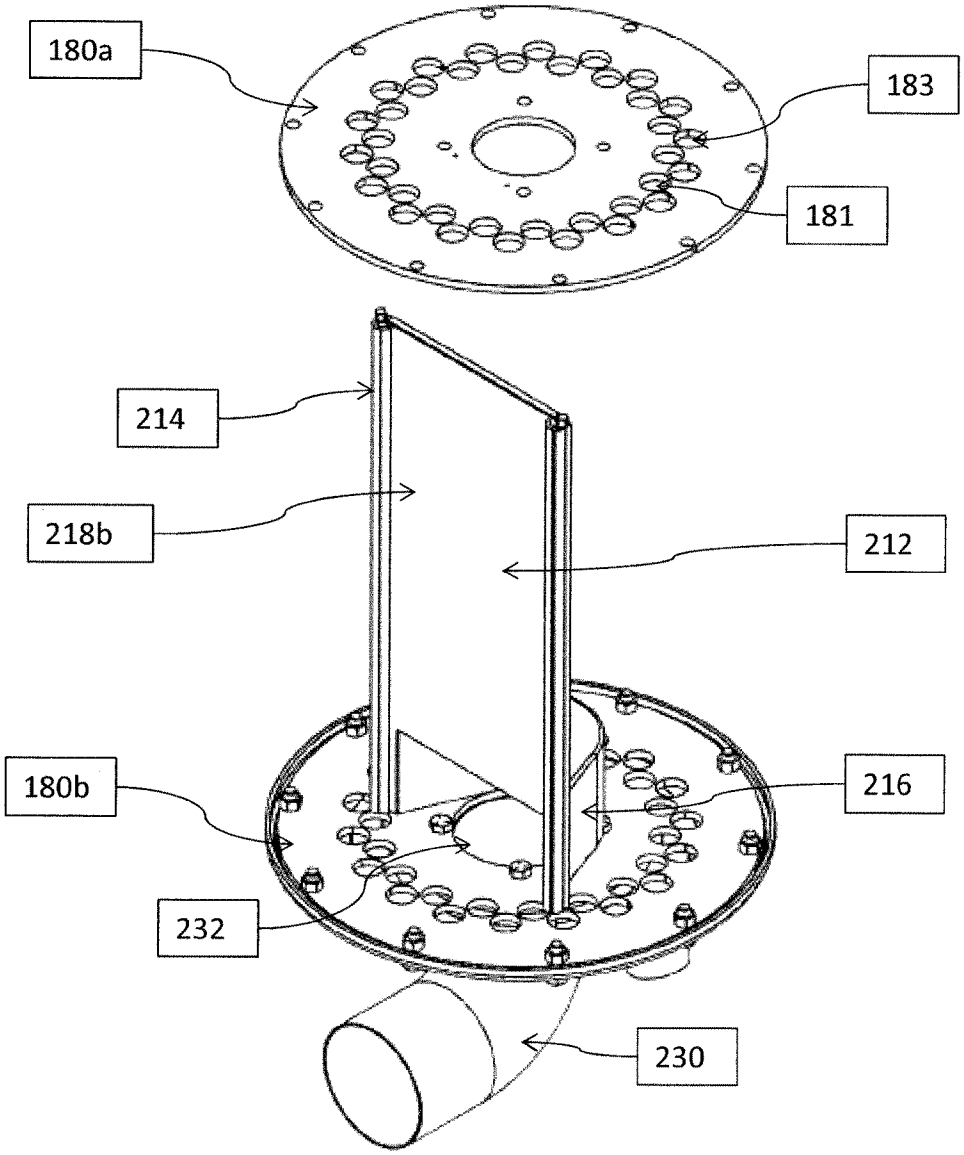
FIG. 6 is a perspective view of select components of the heat exchanger of FIG. 1.
Figure 7B:
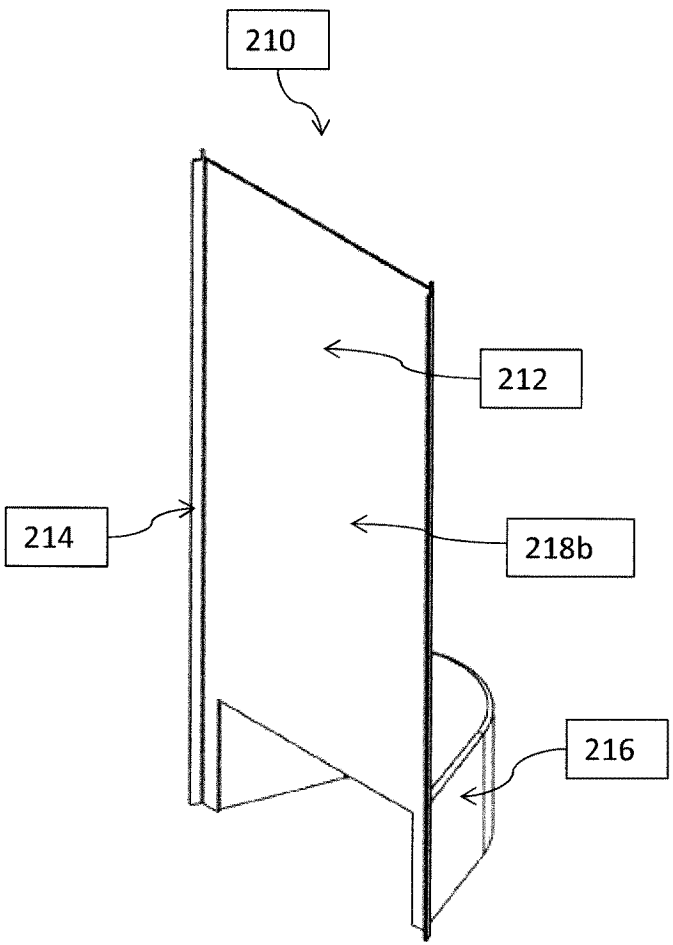
FIGS. 7A-7D are perspective, front, and side views of the divider of FIG. 2.
Figure 7A:
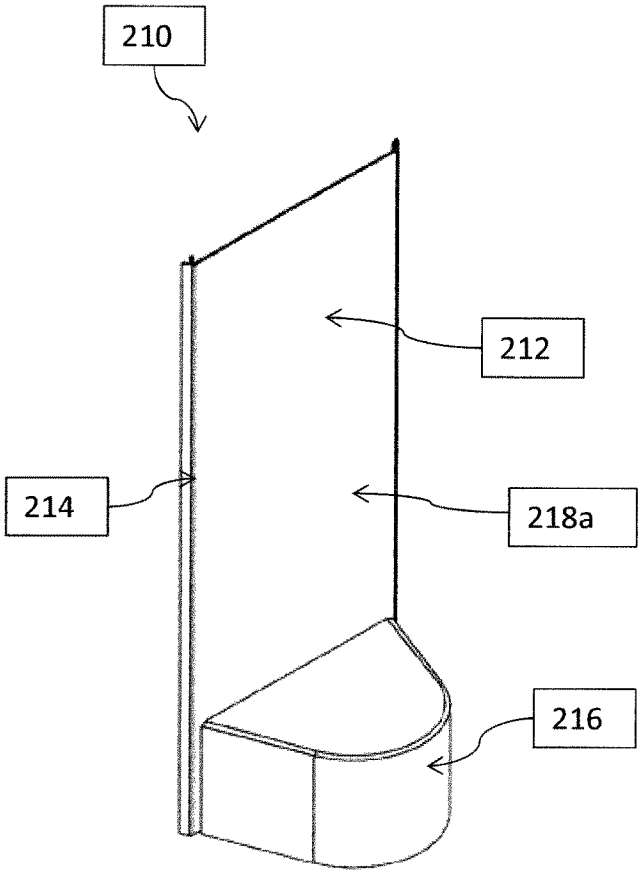
Figure 7D:
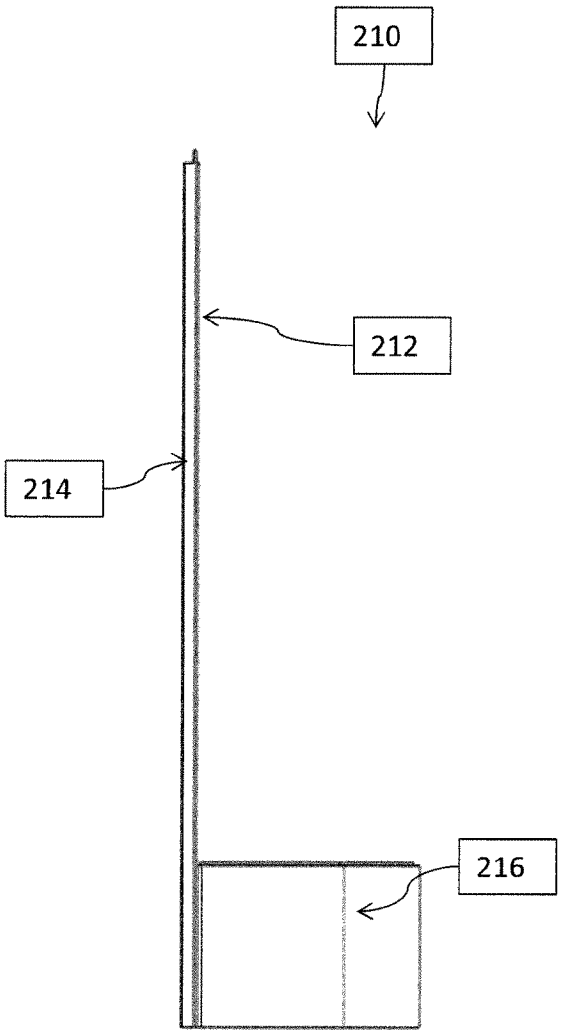
Figure 7C:
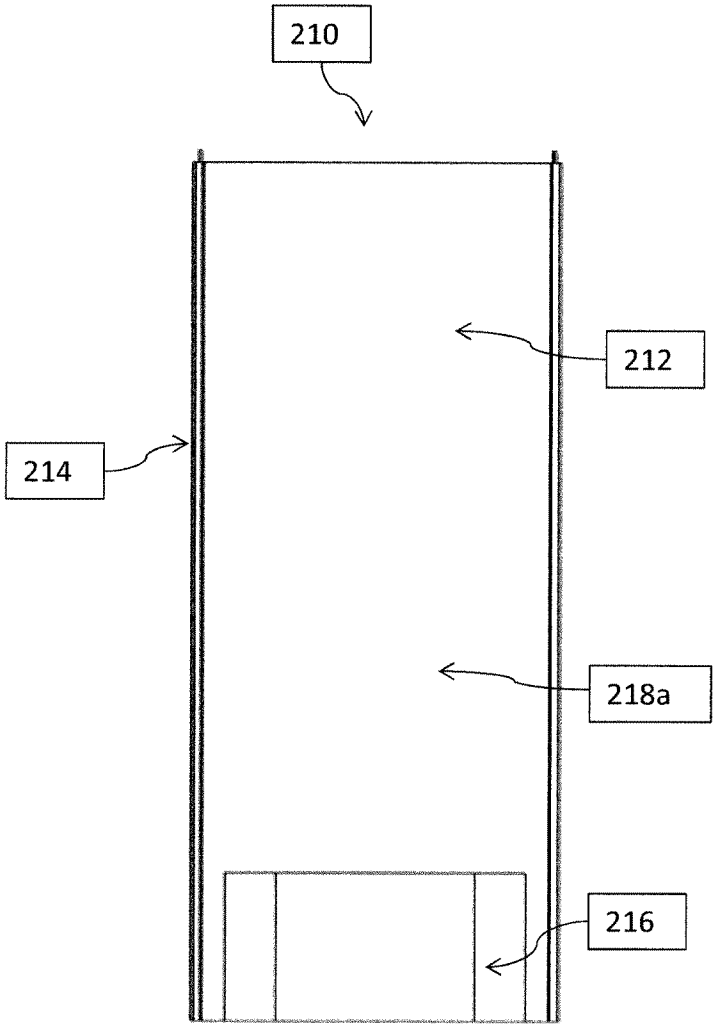

As illustrated in FIG. 5, divider 210 may be positioned such that combustion gases flow from an upstream side 228, defined by a section of interior region 111 extending between a first side 218*a* of divider 210 and shell 110, to a downstream side 229, defined by a section of interior region 111 extending between a second side 218*b* of divider 210 and shell 110 of heat exchanger 100. Combustion gases from burner 120 may be received by upstream side 228 and exhausted from downstream side 229 by combustion gas vent 230. In one embodiment, upstream side 228 includes receiving section 222 and downstream side 229 includes exhaust section 224. Combustion gases may flow from the upstream side 228 to the downstream side 229 by flowing through skirt section 226. For example, the combustion gases may flow from skirt region 226 of upstream side 228 to skirt region 226 of downstream side 229.

Header 170, in conjunction with tube sheet 180, may be employed to redirect water through the plurality of tubes 150. Header 170 and tube sheet 180 together define a cavity between header 170 and tube sheet 180. One or more baffles may extend between header 170 and tube sheet 180 to form at least two compartments interposed header 170 and tube sheet 180. The compartments formed in the cavity between tube sheet 180 and header 170 may be configured to receive and redirect fluid flow through heat exchanger 100. For example, the compartments may direct/redirect fluid flow from one or more of the plurality of tubes 150 to another group of one or more of the plurality of tubes 150.

Heat exchanger 100 may be operable as a counter flow heat exchanger, whereby the colder fluid is heated by cooler combustion gas and hotter fluid is heated by hatter combustion gas. In one embodiment, cold fluid from fluid inlet 106 is directed through one or more of the plurality of tubes 150 disposed in downstream side 229 (e.g., through one or more tubes 150 delineating exhaust section 224) prior to flowing through one or more of the plurality of tubes 150 disposed in upstream side 228 (e.g., through one or more tubes 150 delineating receiving section 222).

The fluid may also flow through the plurality of tubes 150 in downstream side 229 more than once prior to flowing to the plurality of tubes in upstream side 228 and/or may flow through the plurality of tubes 150 in upstream side 228 more than once prior to reaching fluid outlet 108. In one embodiment, the one or more baffles of header 170 align with divider 210, such that a first compartment in header 170 receives fluid (e.g., water) from the plurality of tubes 150 disposed in downstream side 229 and a second compartment in header 170 receives fluid (e.g., water) from the plurality of tubes 150 disposed in upstream side 228.

Although heat exchanger 100 has been illustrated as a vertically oriented heat exchanger having a top first header 180*a* and a bottom second header 180*b*, in one aspect of the invention, the heat exchanger is configured to be horizontally oriented. In such horizontally oriented heat exchangers, the plurality of tubes may extend horizontally between a first header and a second header. The divider may be positioned in the heat exchanger to be substantially parallel with the ground. In one embodiment of a horizontally oriented heat exchanger, the divider is positioned substantially parallel to the ground with the receiving section and/or upstream side located above the divider in the top region of the heat exchanger and the exhaust section and/or the downstream side located below the divider in the bottom region of the heat exchanger.

Even though the invention is illustrated and described herein with reference to specific embodiments, the invention is not intended to be limited to the details shown. Rather, various modifications may be made in the details within the scope and range of equivalents of the claims and without departing from the invention.

What is claimed:

1. A heat exchanger for heating a fluid, the heat exchanger comprising:

a shell coupled to a top tube sheet and a bottom tube sheet, the shell at least partially defining an interior region;

a burner positioned to deliver combustion gases into the interior region;

a plurality of tubes configured to circulate a fluid therein, the plurality of tubes extending through the interior region around the burner; and a divider extending within the interior region from the top tube sheet to the bottom tube sheet and between one of the plurality of tubes and another tube of the plurality of tubes that is not in direct contact with the one of the plurality of tubes, the divider and the plurality of tubes defining a receiving section of the interior region for receiving combustion gases from the burner and an exhaust section of the interior region in fluid communication with a combustion gas vent.

2. The heat exchanger of claim 1, wherein the plurality of tubes includes an inner set of tubes and an outer set of tubes, the inner set of tubes being closer to the burner than the outer set of tubes.

3. The heat exchanger of claim 2, further comprising a plurality of baffle segments positioned in the interior region adjacent the outer set of tubes, adjacent baffle segments defining gaps for the flow of the combustion gases.

4. The heat exchanger of claim 2, wherein the divider is coupled to a first outer tube and a second outer tube that is not in direct contact with the first outer tube.

5. The heat exchanger of claim 4, wherein the divider forms a first seal extending from the top tube sheet to the bottom tube sheet with the first outer tube and a second seal extending from the top tube sheet to the bottom tube sheet with the second outer tube.

6. The heat exchanger of claim 1, further comprising a plurality of baffle segments positioned in the interior region adjacent the plurality of tubes, adjacent baffle segments defining gaps for the flow of the combustion gases.

7. The heat exchanger of claim 6, wherein the combustion gases flow through the gaps defined by adjacent baffle segments at least twice prior to flowing into the combustion gas vent.

8. The heat exchanger of claim 1, further comprising a top header coupled to the top tube sheet and a bottom header coupled to the bottom tube sheet.

9. The heat exchanger of claim 8, wherein the top header includes one or more baffles extending between the top header and the top tube sheet to form at least two compartments interposed between the top header and the top tube sheet.

10. The heat exchanger of claim 9, wherein the one or more baffles of the top header aligns with the divider.

11. A heat exchanger comprising:

a shroud at least partially defining an interior region;

a plurality of tubes annularly arranged in the interior region defined by the shroud and spaced from the shroud, the plurality of tubes extending in an axial direction and defining a center region extending inward from the plurality of tubes and a skirt region interposed between the plurality of tubes and the shroud;

a burner configured to deliver combustion gases to the center region;

a combustion gas vent coupled to the center region for exhausting combustion gases; and a divider positioned to separate the center region by extending between two of the plurality of tubes, the divider positioned such that the combustion gas vent receives combustion gases that flow through the skirt region, the divider comprising a first portion defining opposed axial surfaces having a first length extending in the axial direction and a second portion extending outwardly from one of the opposed axial surfaces of the first portion and having a second length shorter than the first length in a direction different from the axial direction.

12. The heat exchanger of claim 11, wherein the divider separates the center region to form an upstream section in direct communication with the burner and a downstream section in direct communication with the combustion gas vent.

13. The heat exchanger of claim 12, wherein the combustion gases flow from an upstream side of the skirt region to a downstream side of the skirt region.

14. The heat exchanger of claim 11, wherein the plurality of tubes are annularly arranged to form a circular arrangement.

15. A heat exchanger having a divider comprising:

a shell at least partially defining an interior region;

a burner configured to deliver combustion gases into the interior region;

a plurality of tubes configured to circulate a fluid therein, the plurality of tubes extending through the interior region in an axial direction and interposed between the burner and the shell, the plurality of tubes defining a center region extending inwardly from the plurality of tubes;

a combustion gas vent coupled to the center region for exhausting combustion gases from the center region;

a divider interposed between at least two of the plurality of tubes and positioned to separate the interior region into an upstream side adjacent a first side of the divider and a downstream side adjacent an opposed second side of the divider, wherein the combustion gases from the burner are received by the upstream side and the combustion gases are exhausted from the downstream side by the combustion gas vent, the divider comprising a first portion defining opposed axial surfaces having a first length extending in the axial direction and a second portion extending outwardly from one of the opposed axial surfaces of the first portion and having a second length shorter than the first length in a direction different from the axial direction.

16. The heat exchanger of claim 15, wherein the fluid flows through one or more tubes of the plurality of tubes disposed in the downstream side prior to flowing through one or more tubes disposed in the upstream side.

17. The heat exchanger of claim 15, wherein the divider extends between the burner and the combustion gas vent.

* * * * *